US011971202B2

(12) United States Patent
Najima et al.

(10) Patent No.: US 11,971,202 B2
(45) Date of Patent: Apr. 30, 2024

(54) AIR-CONDITIONING APPARATUS

(71) Applicant: Mitsubishi Electric Corporation, Tokyo (JP)

(72) Inventors: Kohei Najima, Tokyo (JP); Yutaka Aoyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 351 days.

(21) Appl. No.: 17/440,825

(22) PCT Filed: May 31, 2019

(86) PCT No.: PCT/JP2019/021813
§ 371 (c)(1),
(2) Date: Sep. 20, 2021

(87) PCT Pub. No.: WO2020/240852
PCT Pub. Date: Dec. 3, 2020

(65) Prior Publication Data

US 2022/0163243 A1 May 26, 2022

(51) Int. Cl.
*F25B 41/00* (2021.01)
*F25B 5/02* (2006.01)
(Continued)

(52) U.S. Cl.
CPC ..... *F25B 41/20* (2021.01); *F25B 5/02* (2013.01)

(58) Field of Classification Search
CPC ..... F25B 41/20; F25B 5/02
(Continued)

(56) References Cited

U.S. PATENT DOCUMENTS

2009/0056357 A1 3/2009 Kang et al.
2011/0219803 A1 9/2011 Park et al.

FOREIGN PATENT DOCUMENTS

CN 101377331 A 3/2009
CN 203869388 U 10/2014
(Continued)

OTHER PUBLICATIONS

International Search Report of the International Searching Authority dated Jul. 9, 2019 in corresponding International Patent Application No. PCT/JP2019/021813 (and English translation).
(Continued)

*Primary Examiner* — Davis D Hwu
(74) *Attorney, Agent, or Firm* — POSZ LAW GROUP, PLC

(57) ABSTRACT

In an air-conditioning apparatus, an outdoor unit installed in an outdoor space and an indoor unit installed in an indoor space are connected by refrigerant pipes to form a refrigerant circuit. One or more pairs of valve kits are provided at the refrigerant pipes by which the outdoor unit and the indoor unit are connected, and allow a pair of additional refrigerant pipes on an inflow side and an outflow side to be connected to one of the one or more pairs of valve kits, the pair of additional refrigerant pipes being additionally provided to enable a new indoor unit to be added after installation of the air-conditioning apparatus. The valve kits of the one or more pairs of valve kits have respective distal end portions that are inclined upwards relative to a horizontal direction. The distal end portions each allow an associated one of the additional refrigerant pipe to be connected to the distal end portion.

12 Claims, 5 Drawing Sheets

(51) Int. Cl.
*F25B 41/20* (2021.01)
*F25B 49/00* (2006.01)

(58) Field of Classification Search
USPC ..... 62/196.1
See application file for complete search history.

(56) References Cited

FOREIGN PATENT DOCUMENTS

| | | | | |
|---|---|---|---|---|
| CN | 204100665 | U | | 1/2015 |
| EP | 2 031 314 | A2 | | 3/2009 |
| EP | 2 402 671 | A2 | | 1/2012 |
| EP | 2 716 982 | A2 | | 4/2014 |
| EP | 3 026 374 | A1 | | 6/2016 |
| JP | H05-149638 | A | | 6/1993 |
| JP | H09-126575 | A | | 5/1997 |
| JP | 2000-097453 | A | | 4/2000 |
| JP | 2007-010288 | A | | 1/2007 |
| JP | 2008-249238 | A | | 10/2008 |
| JP | 2010071497 | A | * | 4/2010 |
| JP | 4895891 | B | | 3/2012 |
| KR | 2006-0055153 | A | | 5/2006 |
| KR | 2010-0097296 | A | | 9/2010 |
| KR | 2011-0102612 | A | | 9/2011 |

OTHER PUBLICATIONS

Decision of Rejection dated Jun. 27, 2023 issued in corresponding CN patent application No. 201980095357.3 (and Machine Translation).

Office Action dated Aug. 2, 2022 issued in corresponding CN Patent Application No. 201980095357.3 (and English translation).

Office Action dated Feb. 24, 2023 issued in corresponding CN Patent Application No. 201980095357.3 (and English translation).

Extended European Search Report dated May 9, 2022 issued in corresponding European Patent Application No. 19930607.7.

* cited by examiner

AIR-CONDITIONING APPARATUS

CROSS REFERENCE TO RELATED APPLICATION

This application is a U.S. national stage application of PCT/JP2019/021813 filed on May 31, 2019, the contents of which are incorporated herein by reference.

TECHNICAL FIELD

The present disclosure relates to an air-conditioning apparatus in which an outdoor unit installed outdoors and an indoor unit installed indoors are connected by refrigerant pipes to form a refrigerant circuit.

BACKGROUND ART

In an existing air-conditioning apparatus such as a multi-split air-conditioning apparatus for a building, an outdoor unit is installed outdoors, and an indoor unit or units are installed indoors. In such an air-conditioning apparatus, in a heating operation, refrigerant that circulates in a refrigerant circuit transfers heat to air supplied to a heat exchanger in the indoor unit, thereby heating the air, and the heated air is sent to an air-conditioned space; and in a cooling operation, the refrigerant that circulates in the refrigerant circuit receives heat from air supplied to the heat exchanger of the indoor unit, thereby cooling the air, and the cooled air is sent to the air-conditioned space (for example, see Patent Literature 1).

Such an air-conditioning apparatus as descried above is designed such that the load of components to be selected is equal to the load of a building. It should be noted that the loads are calculated such that an air-conditioning performance in the heating operation or the cooling operation varies from one region to another.

CITATION LIST

Patent Literature

Patent Literature 1: Japanese Unexamined Patent Application Publication No. 2007-10288

SUMMARY OF INVENTION

Technical Problem

When an existing air-conditioning apparatus is installed in a building, components are selected such that in each of floors, the load of an indoor space and the load of an indoor unit are equal to each other. However, in some cases, after installation of an air-conditioning apparatus, the load of an indoor space and the load of an indoor unit that are initially designed are not equal to each other. This is because both the loads change due to a changing load such as a person or persons who enter or leave the building, partitions in each of the floors, and for other reasons. In the case where the load of the indoor space is larger than the load of the indoor unit, an air-conditioning performance of the indoor unit that heats or cools the indoor space is insufficient, and thus needs to be enhanced. In the case where the air-conditioning performance needs to be enhanced, it is necessary to carry out a construction work and to stop the air-conditioning apparatus installed in the building. Thus, an additional work is complicated.

The present disclosure is applied to solve the above problem, and relates to an air-conditioning apparatus that enables a new indoor unit or units to be easily added without stopping the air-conditioning apparatus, after the air-conditioning apparatus is installed in a building.

Solution to Problem

In an air-conditioning apparatus according to an embodiment of the present disclosure, an outdoor unit installed in an outdoor space and an indoor unit installed in an indoor space are connected by refrigerant pipes to form a refrigerant circuit. One or more pairs of valve kits are provided at the refrigerant pipes by which the outdoor unit and the indoor unit are connected, and allow a pair of additional refrigerant pipes on an inflow side and an outflow side to be connected to one of the one or more pairs of valve kits, the pair of additional refrigerant pipes being additionally provided to enable a new indoor unit to be added after installation of the air-conditioning apparatus. The valve kits of the one or more pairs of valve kits have respective distal end portions that are inclined upwards relative to a horizontal direction. The distal end portions each allow an associated one of the additional refrigerant pipe to be connected to the distal end portion.

Advantageous Effects of Invention

In the air-conditioning apparatus according to the embodiment of the present disclosure, the one or more valve kits are provided on the indoor-side refrigerant pipes that connect the outdoor unit and the indoor unit. A pair of refrigerant pipes on an inflow side and an outflow side is connectable to one of the one or more pairs of valve kits. The pair of refrigerant pipes is additionally provided as additional refrigerant pipes to enable the new indoor unit to be newly added after installation of the air-conditioning apparatus. The valve kits of the one or more pairs of valve kits are provided to have respective distal end portion inclined upwards relative to the horizontal direction. Each of the distal end portions allow an associated one of the additional refrigerant pipes to be connected to the distal end portion. As a result, it is possible to easily add the new indoor unit, using the valve kits, without stopping the air-conditioning apparatus already installed in the building. It is therefore possible to easily add the new indoor unit without stopping the air-conditioning apparatus already installed in the building.

DESCRIPTION OF EMBODIMENTS

Figure 1:
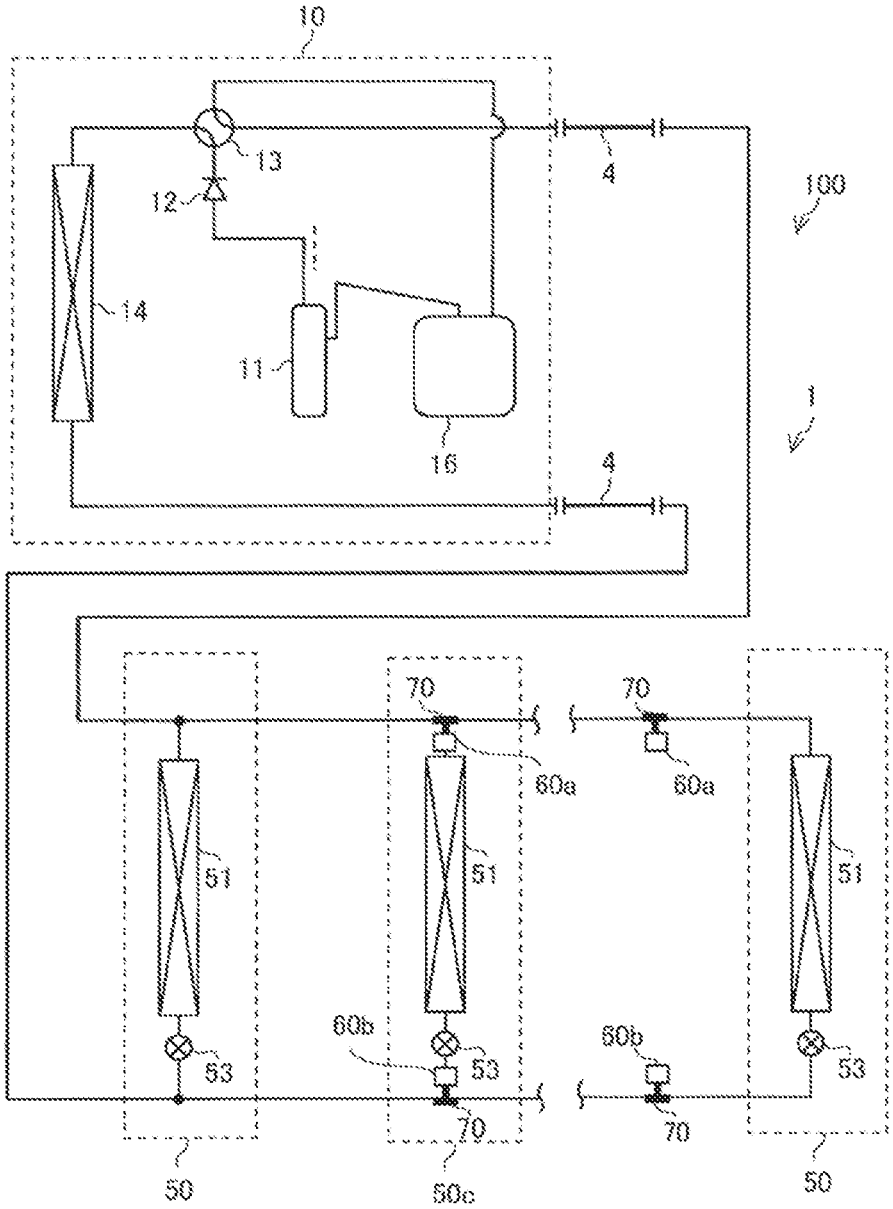
FIG. 1 is a refrigerant circuit diagram illustrating an air-conditioning apparatus according to Embodiment 1.

An embodiment of the present disclosure will be described below with reference to drawings. It should be noted that in each of figures in the drawings, components that are the same as or equivalent to a previous figure or figures are denoted by the same reference signs, and the same is true of the entire text of the present specification. Furthermore, in a sectional view, hatching is omitted as appropriate in view of visibility. In the entire text of the specification, configurations of components are descried as examples, and these descriptions are not limiting.

Embodiment 1

Figure 2:
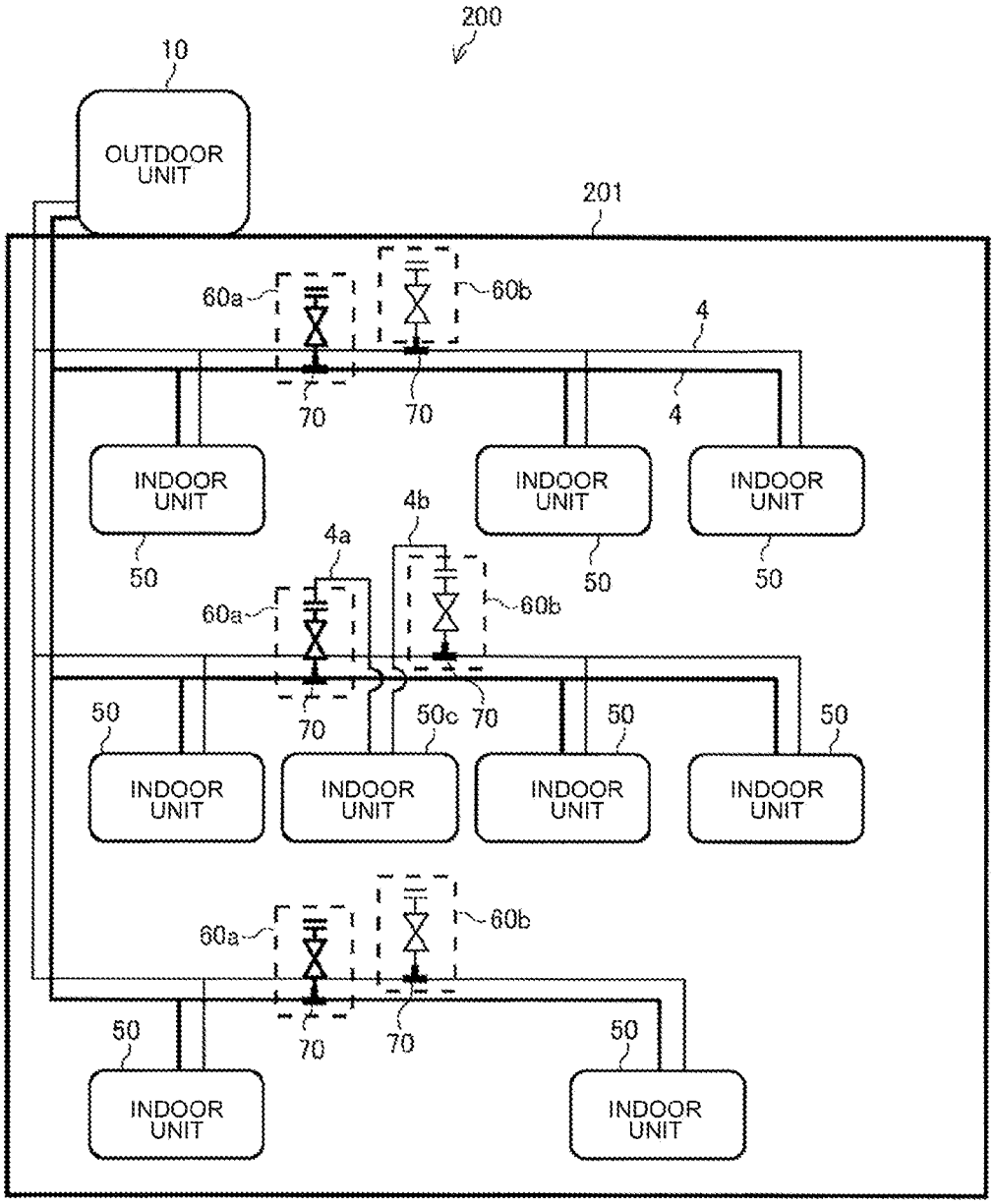
FIG. 2 is an explanatory view illustrating an installed state of the air-conditioning apparatus according to Embodiment 1.

FIG. 1 is a refrigerant circuit diagram illustrating an air-conditioning apparatus 100 according to Embodiment 1. FIG. 2 is an explanatory view illustrating an installed state of the air-conditioning apparatus 100 according to Embodiment 1. As illustrated in FIGS. 1 and 2, the air-conditioning apparatus 100 includes a refrigerant circuit 1 that circulates refrigerant. In the air-conditioning apparatus 100, a cooling mode or a heating mode can be freely selected as an operation mode of each of indoor units 50.

The air-conditioning apparatus 100 includes the indoor units 50 and an outdoor unit 10 that is a heat-source unit. The outdoor unit 10 and the indoor units 50 are connected by refrigerant pipes 4 to form the refrigerant circuit 1. The outdoor unit 10 includes a compressor 11, a backflow prevention device 12, a four-way valve 13, and a heat-source-side heat exchanger 14. Each of the indoor units 50 includes a use-side heat exchanger 51 and an expansion device 53.

As illustrated in FIG. 2, the outdoor unit 10 is installed in an outdoor space 200 located outside a building. The indoor units 50 are installed in indoor spaces 201 of the building. The outdoor space 200 in which the outdoor unit 10 is installed is an outdoor space at a rooftop of the building that is located above the indoor units 50 in an upward direction U. The above description concerning the location of the outdoor unit 10, however, is not limiting. The outdoor unit 10 may be installed in an outdoor space 200 that is located outside the building and at a position lower than the positions of the indoor units 50.

When the air-conditioning apparatus 100 is installed in the building, in each of floors that are located as illustrated in FIG. 2, components to be provided are selected such that an indoor space load that is the load of an indoor space or spaces and an indoor unit load that is the load of indoor units are equal to each other. However, after installation of the air-conditioning apparatus 100, in some cases, the indoor space load and the indoor unit load initially designed are not equal to each other. This is because the loads change due to a changing load such as a person or persons who enter or leave the building, partitions in each of the floors, and for other reasons. In the case where the indoor space load is larger than the indoor unit load, an air-conditioning performance of the indoor units 50 that heat or cool the indoor space is insufficient.

When the air-conditioning performance is insufficient, comfort of the indoor space is deteriorated. Therefore, one or more pairs of valve kits 60*a* and 60*b* as described below are provided in the air-conditioning apparatus 100.

<Configuration of Valve Kits 60*a* and 60*b*>

Figure 3:
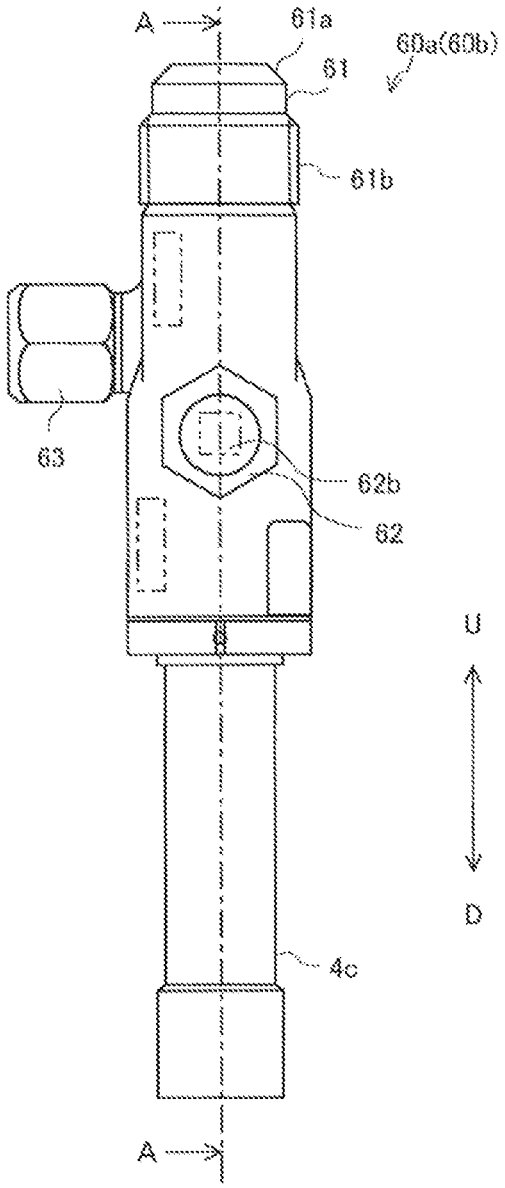
FIG. 3 is a plan view illustrating a valve kit in Embodiment 1.
Figure 4:
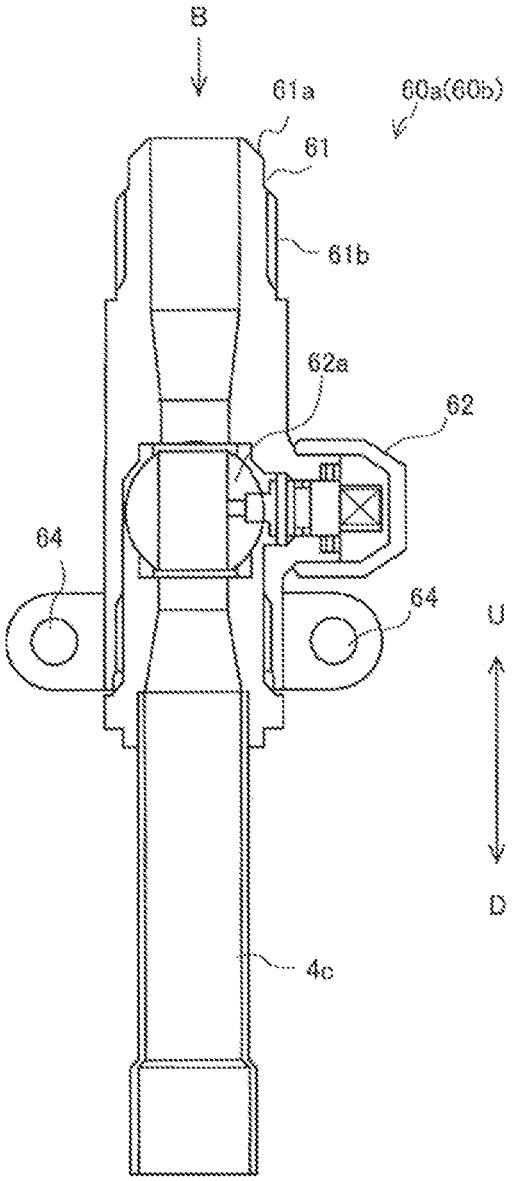
FIG. 4 is an explanatory view illustrating a section of the valve kit in Embodiment 1 that is taken along line A-A in FIG. 3.
Figure 5:
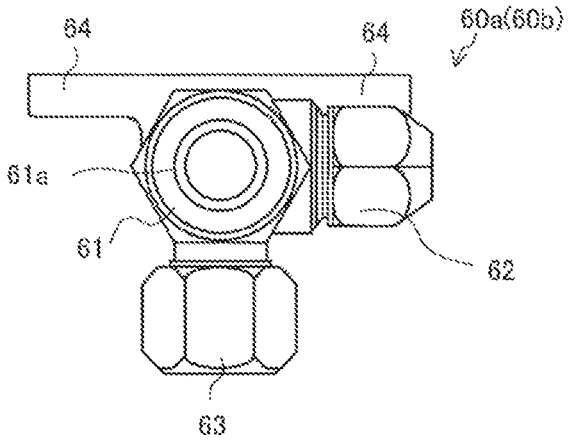
FIG. 5 is a top view illustrating the valve kit in Embodiment 1 as viewed in a direction indicated by an arrow B in FIG. 4.
Figure 6:
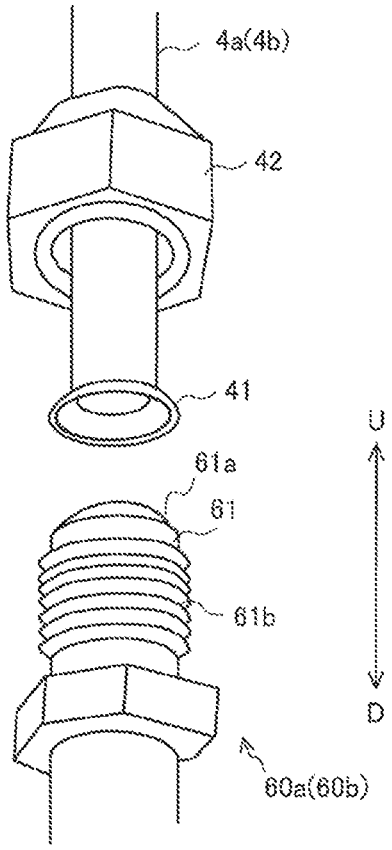
FIG. 6 is a perspective view illustrating the valve kit in Embodiment 1 and a refrigerant pipe to be additionally provided.

FIG. 3 is a plan view illustrating the valve kit 60*a* or 60*b* in Embodiment 1. FIG. 4 is an explanatory diagram illustrating a section of the valve kit 60*a* or 60*b* in Embodiment 1 that is taken along line A-A in FIG. 3. FIG. 5 is a top view illustrating the valve kit 60*a* or 60*b* in Embodiment 1 as viewed in a direction indicated by an arrow B in FIG. 4. FIG. 6 is a perspective view illustrating the valve kit 60*a* or 60*b* in Embodiment 1 and a refrigerant pipe 4*a* or 4*b* to be additionally provided.

As illustrated in FIGS. 2, 3, 4, 5, and 6, one or more pairs of valve kits 60*a* and 60*b* are provided at the indoor-side refrigerant pipes 4 that connect the outdoor unit 10 and the indoor units 50, and a pair of refrigerant pipes 4*a* and refrigerant pipe 4*b* on an inflow side and an outflow side can be connected to one of the one or more pairs of valve kits 60*a* and 60*b*. The pair of refrigerant pipes 4*a* and 4*b* are additionally provided as additional pipes to enable a new indoor unit 50*c* to be additionally installed after installation of the air-conditioning apparatus 100. Referring to FIG. 2, in each of the floors, one pair of valve kits 60*a* and 60*b* are provided.

As illustrated in FIG. 2, branch joints 70 are provided in respective middle portions of the indoor-side refrigerant pipes 4 connecting the outdoor unit 10 and the indoor units 50. At each of the branch joints 70, an associated one of the refrigerant pipes 4*a* and 4*b* connected to the one or more pairs of valve kits 60*a* and 60*b* branches off. A refrigerant pipe 4*c* that extends as a branch pipe from each of the branch joints 70 extends upwards in a vertical direction. Therefore, a portion from each of the refrigerant pipes 4 connecting the outdoor unit 10 and the plurality of indoor units 50 to a distal end portion 61 of an associated one of the valve kits 60*a* and 60*b* extends upward in the vertical direction. Of each of the indoor-side refrigerant pipes 4 connecting the outdoor unit 10 and the indoor units 50, part of the indoor-side refrigerant pipe 4 that extends before reaching the branch joint 70 is made to have a pipe diameter larger than a pipe diameter of each of refrigerant pipes for use in operation that is performed with an air-conditioning performance prior to addition of a new indoor unit or units 50*c*, in order to enable the air-conditioning performance to be enhanced as the number of new indoor units 50*c* is increased.

It should be noted that depending on the installed state of the air-conditioning apparatus, the refrigerant pipe connected to the valve kit 60*a* or 60*b* may be made to branch, without provision of the branch joint 70, from the middle of an associated one of the indoor-side refrigerant pipes 4 connecting the outdoor unit 10 and the indoor units 50.

As illustrated in FIGS. 2, 3, 4, 5, and 6, each of the valve kits 60*a* and 60*b* straightly extends upwards in the vertical direction on an extension above the associated additional refrigerant pipe 4*a* or 4*b* that extends upwards from the branch joint 70 in the vertical direction. In other words, each of the valve kits 60*a* and 60*b* extends upwards in the vertical direction over the entire portion thereof from the distal end portion 61 that is be connected to the additional refrigerant pipe 4*a* or 4*b* to a downstream side of an operation valve 62. It should be noted that it suffices that each of the valve kits 60*a* and 60*b* is inclined upwards to a horizontal direction. Also, it suffices that the above portion from each of the refrigerant pipe 4 connecting the outdoor unit 10 and the indoor unit 50 to the distal end portion 61 of each of the valve kits 60*a* and 60*b* is inclined upwards relative to the horizontal direction. An outside diameter of each of the valve kits 60*a* and 60*b* is larger than an outside diameter of each of the refrigerant pipes 4*a* and 4*b*. Each of the valve kits 60*a* and 60*b* is a tubular member. A flow passage in each of the valve kits 60*a* and 60*b* is narrower than a flow passage in each of the refrigerant pipes 4*a* and 4*b*.

As illustrated in FIGS. 3, 4, 5, and 6, each of the valve kits 60*a* and 60*b* includes the operation valve 62 and a port 63. The operation valve 62 can be opened and closed for refrigerant that flows through the inside of the valve kit 60*a* or 60*b*. The port 63 is provided closer to the distal end portion 61 than the operation valve 62 in the upward direction U, and is open from the outside to the flow passage.

At an outer peripheral portion in the middle of each of the valve kits 60*a* and 60*b* in the vertical direction, a pair of attachment hole portions 64 are provided. The attachment hole portions 64 protrude from the body of the valve kit in the horizontal direction and are symmetrical and fixed by fixing members.

The operation valve 62 has a valve body 62*a* in the valve kit 60*a* or 60*b*. The operation valve 62 includes an operation unit 62*b* that enables the valve body 62*a* to be rotatably operated from the outside to open/close the flow passage in the valve body 62*a*. When a worker inserts a tool into the operation unit 62*b* and turns the operation unit 62*b*, the flow passage in the valve body 62*a* is opened or closed. When being opened, the flow passage in the valve body 62*a* communicates with the flow passage in the valve kit 60*a* or 60*b* on both sides thereof in the vertical direction. When the flow passage in the valve body 62*a* is closed, the axial direction of the flow passage is changed from the vertical direction to the horizontal direction, and thus the flow passage does not communicate with the flow passage in the valve kit 60*a* or 60*b* on the both sides thereof in the vertical direction.

The port 63 communicates with the outside and the flow passage in the valve kit 60*a* or 60*b* in the upward direction U. The port 63 is used in evacuation of a refrigerant flow passage formed by an associated one of the additional refrigerant pipes 4*a* and 4*b* on the inflow side and the outflow side and the new indoor unit 50*c*, at the time of adding the new indoor unit 50*c*.

At a distal end of the distal end portion 61 of each of the valve kits 60*a* and 60*b* in the upward direction U, a dome-shaped flare 61*a* is provided. The dome-shaped flare 61*a* can be jointed to a large-diameter tapered flare 41 that is provided at an end part of the additional refrigerant pipe 4*a* or 4*b* in a downward direction D.

A screw portion 61*b* is provided on an outer peripheral portion of the distal end portion 61 of each of the valve kits 60*a* and 60*b*. The screw portion 61*b* is screwed to a flare nut 42 provided on the additional refrigerant pipe 4*a* or 4*b*. The screw portion 61*b* is located below the distal end of the distal end portion 61 that has the shape of the dome-shaped flare 61*a* in such a manner as to be screwable to the flare nut 42 provided on the additional refrigerant pipe 4*a* or 4*b*. It should be noted that a nut other than the flare nut 42 may be provided on the additional refrigerant pipe 4*a* or 4*b*.

<Action>

When the new indoor unit 50*c* is additionally installed, the refrigerant pipes 4*a* and 4*b* on the inflow side and the outflow side that are to be added on a secondary side of one pair of valve kits 60*a* and 60*b* and the new indoor unit 50*c* are connected to refrigerant pipes 4 already provided, using the pair of valve kits 60*a* and 60*b*. Furthermore, only the refrigerant flow passage formed by one of the additional refrigerant pipes 4*a* and 4*b* on the inflow side and the outflow side and the new indoor unit 50*c* is evacuated using the port 63. Thereafter, the operation valve 62 is opened, and the new indoor unit 50*c* is supplied with refrigerant that flows through the refrigerant pipes 4 of the air-conditioning apparatus 100 already installed in the building. By carrying out only such a construction work, it is possible to easily add the new indoor unit 50*c*, and improve the air-conditioning performance of the air-conditioning apparatus 100 already installed, without stopping the operation of the air-conditioning apparatus 100.

In the case where the valve kits 60*a* and 60*b* are not provided, and the air-conditioning performance needs to be improved, it is necessary to suspend the operation of the air-conditioning apparatus 100 in order to add the new indoor unit 50*c*, and to recover all the refrigerant in the air-conditioning apparatus 100. Thus, the work of additionally installing the new indoor unit is complicated.

The valve kits 60*a* and 60*b* are provided to extend upwards in the vertical direction relative to the refrigerant pipes 4 that connect the outdoor unit 10 and the indoor units 50 before reaching the branch joints 70. Therefore, during the operation of the air-conditioning apparatus 100, refrigerating machine oil that flows through the refrigerant pipes 4 flows downwards in the valve kit 60*a* or 60*b* due to gravity, and does not stay in the valve kit 60*a* or 60*b*.

It should be noted that in order to improve the air-conditioning performance, it is indispensable to improve the air-conditioning performance of the outdoor unit 10 already installed. Therefore, an outdoor unit 10 that is designed to have a capacity margin is previously selected at the timing of installing the air-conditioning apparatus 100. More specifically, the air-conditioning performance of the outdoor unit 10 is enhanced in advance by the number of additional indoor units 50 to be additionally installed, compared with an air-conditioning performance necessary for the number of indoor units 50 at the time of installing the indoor units 50. For example, at the time of installing the air-conditioning apparatus 100 having rated cooling capacity of 28 kW, it is appropriate that the outdoor unit 10 is designed to have a margin of 20 to 30%. In order that electric wires that are connected to the outdoor unit 10 support the air-conditioning performance after the air-conditioning performance is enhanced, the diameter of each of electric wires that are connected to the outdoor unit 10 is set larger than that of each of electric wires for use in the air-conditioning performance before a new indoor unit is added.

An upper limit value is set as a compressor frequency of the outdoor unit 10 or an outdoor fan, based on a basic horsepower. In the case where the air-conditioning performance is enhanced, however, the upper limit value is changed, and an air-conditioning performance required for the indoor space load can be fulfilled. It is appropriate that it is determined whether the air-conditioning performance is enhanced or not, based on, for example, switch setting of the outdoor unit 10 or a total capacity of the indoor units 50 and the new indoor unit 50*c*, and the upper limit value is automatically changed.

Advantages of Embodiment 1

According to Embodiment 1, in the air-conditioning apparatus 100, the outdoor unit 10 installed in the outdoor space 200 and the indoor units 50 installed in the indoor spaces 201 are connected by the refrigerant pipes 4 to form the refrigerant circuit 1. The one or more pairs of valve kits 60*a* and 60*b* are provided at the refrigerant pipes 4 connecting the outdoor unit 10 and the indoor units 50. To one of the one or more pairs of valve kits 60*a* and 60*b*, the pair of refrigerant pipes 4*a* and 4*b* on the inflow side and the outflow side are connectable. The pair of refrigerant pipes 4*a* and 4*b* are additionally provided to enable the new indoor unit 50*c* to be added after installation of the air-conditioning apparatus 100. Each of the valve kits of the one or more pairs of valve kits 60*a* and 60*b* is provided such that the distal end portion 61 is inclined upwards relative to the horizontal direction. To each of the distal end portions 61, the additional refrigerant pipe 4*a* or 4*b* to be additionally provided is connected.

Because of provision of the above configuration, it is possible to easily add the new indoor unit 50*c*, using the valve kit 60*a* or 60*b*, without stopping the air-conditioning apparatus 100 already installed in the building. At this time, the refrigerating machine oil that is mixed with the refrigerant flowing through the refrigerant pipes 4 of the air-conditioning apparatus 100 already installed in the building and that has specific gravity greater than specific gravity of the refrigerant flows downwards from the valve kit 60*a* or 60*b* extending upwards, and does not stay in the valve kit 60*a* or 60*b*. Therefore, the refrigerating machine oil does not soil the inside of the valve kit 60*a* or 60*b*. Therefore, when the additional refrigerant pipe 4*a* or 4*b* is connected to the valve kit 60*a* or 60*b*, the refrigerating machine oil does not flow into the new indoor unit 50*c* from the valve kit 60*a* or 60*b*, and needless to say, the new indoor unit 50*c* is not broken by the refrigerating machine oil. Therefore, the worker can easily perform the work of additionally installing the new indoor unit 50*c*. That is, it is possible to easily add the new indoor unit 50*c* without stopping the air-conditioning apparatus 100 already installed in the building.

According to Embodiment 1, the distal end portion 61 of each of the valve kits 60*a* and 60*b* of the one or more pairs of valve kits 60*a* and 60*b* extends upwards in the vertical direction.

In the above configuration, the refrigerating machine oil that is mixed with the refrigerant that flows through the refrigerant pipes 4 of the air-conditioning apparatus 100 already installed in the building and has the specific gravity greater than the specific gravity of the refrigerant straightly flows downwards due to gravity from the valve kit 60*a* or 60*b* that extends upwards in the vertical direction, and does not stay in the valve kit 60*a* or 60*b*. Therefore, the refrigerating machine oil does not soil the inside of the valve kit 60*a* or 60*b*.

According to Embodiment 1, the portion from each of the refrigerant pipes 4 connecting the outdoor unit 10 and the indoor units 50 to an associated one of the distal end portions 61 is inclined upwards relative to the horizontal direction.

In the above configuration, the refrigerating machine oil that is mixed with the refrigerant that flows through the refrigerant pipes 4 of the air-conditioning apparatus 100 already installed in the building and has the specific gravity greater than the specific gravity of the refrigerant flows downwards due to the gravity from the valve kit 60*a* or 60*b* that extends upwards or from the refrigerant pipes 4*c* located below the valve kit 60*a* or 60*b* in the downward direction D, and does not stay in the valve kit 60*a* or 60*b*. Therefore, the refrigerating machine oil does not soil the inside of the valve kit 60*a* or 60*b*.

According to Embodiment 1, the air-conditioning performance of the outdoor unit 10 is previously enhanced by the number of indoor units 50 to be additionally installed, compared with an air-conditioning performance necessary for the number of indoor units 50 at the time of installation thereof.

In the above configuration, even when the indoor unit 50*c* is newly added, the outdoor unit 10 can fulfill the air-conditioning performance without difficulty.

According to Embodiment 1, each of the valve kits 60*a* and 60*b* of the one or more pairs of valve kits 60*a* and 60*b* includes the operation valve 62 that can be freely opened and closed for the refrigerant that flows through the valve kit 60*a* or 60*b*. Each of the valve kits 60*a* and 60*b* of the one or more pairs of valve kits 60*a* and 60*b* also has the port 63 that is provided closer to the distal end portion 61 than the operation valve 62 in the upward direction U, and that is open from the outside to the inside.

In the above configuration, when being additionally installed, the new indoor unit 50*c* is first installed along with the additional refrigerant pipes 4*a* and 4*b* on the inflow side and the outflow side. Furthermore, only the refrigerant flow passages formed by the additional refrigerant pipes 4*a* and 4*b* on the inflow side and the outflow side and the new indoor unit 50*c* are evacuated using the port 63. Thereafter, the operation valve 62 is opened, and the new indoor unit 50*c* is supplied with the refrigerant that flows through the refrigerant pipes 4 of the air-conditioning apparatus 100 already installed in the building. Therefore, it is possible to add the new indoor unit 50*c* without stopping operation of the air-conditioning apparatus 100 already installed in the building.

According to Embodiment 1, at the distal end of each of the distal end portions 61, the dome-shaped flare 61*a* is provided. The dome-shaped flare 61*a* is joinable to the large-diameter tapered flare 41 provided at an end portion of the additional refrigerant pipe 4*a* or 4*b*.

In the above configuration, the dome-shaped flare 61*a* and the large-diameter tapered flare 41 are joined to each other, thereby enabling the new indoor unit 50*c* to be added.

According to Embodiment 1, on the outer peripheral portion of each of the distal end portions 61, the screw portion 61*b* is provided. The screw portion 61*b* is screwed to the flare nut 42 provided on the additional refrigerant pipe 4*a* or 4*b*.

In the above configuration, the screw portion 61*b* and the flare nut 42 are screwed to each other, thereby enabling the new indoor unit 50*c* to be added.

According to Embodiment 1, the screw portion 61*b* is provided below the distal end of the distal end portion 61 having the shape of the dome-shaped flare 61*a*, in such a manner as to be screwable to the flare nut 42 provided on the additional refrigerant pipe 4*a* or 4*b*.

In the above configuration, the screw portion 61*b* and the flare nut 42 are screwed to each other. As a result, it is possible to add the new indoor unit 50*c*, with the dome-shaped flare 61*a* and the large-diameter tapered flare 41 joined to each other and a joint portion therebetween sealed.

According to Embodiment 1, the branch joints 70 are provided in the respective middles of the refrigerant pipes 4 that connect the outdoor unit 10 and the indoor units 50. At each of the branch joints 70, an associated one of the refrigerant pipes 4*a* and 4*b* connected to the one or more pairs of valve kits 60*a* and 60*b* branches off.

In the above configuration, at each of the branch joints 70, the refrigerant pipe 4*c* connected to the valve kit 60*a* or 60*b* can previously branch off from the refrigerant pipes 4 included in the refrigerant circuit 1.

REFERENCE SIGNS LIST

1: refrigerant circuit, 4: refrigerant pipe, 4*a*: refrigerant pipe, 4*b*: refrigerant pipe, 4*c*: refrigerant pipe, 10: outdoor unit, 11: compressor, 12: backflow prevention device, 13: four-way valve, 14: heat-source-side heat exchanger, 41: large-diameter tapered flare, 42: flare nut, 50: indoor unit, 50*c*: new indoor unit, 51: use-side heat exchanger, 53: expansion device, 60*a*: valve kit, 60*b*: valve kit, 61: distal end portion, 61*a*: dome-shaped flare, 61*b*: screw portion, 62: operation valve, 62*a*: valve body, 62*b*: operation portion, 63: port, 64: attachment hole portion, 70: branch joint, 100: air-conditioning apparatus, 200: outdoor space, 201: indoor space

The invention claimed is:

1. An air-conditioning apparatus in which an outdoor unit installed in an outdoor space and an indoor unit installed in an indoor space are connected by refrigerant pipes to form a refrigerant circuit, wherein one or more pairs of valve kits are provided at the refrigerant pipes by which the outdoor unit and the indoor unit are connected, and allow a pair of additional refrigerant pipes on an inflow side and an outflow side to be connected to one of the one or more pairs of valve kits, the pair of additional refrigerant pipes being additionally provided to enable a new indoor unit to be added after installation of the air-conditioning apparatus, the valve kits of the one or more pairs of valve kits have respective distal end portions that are inclined upwards relative to a horizontal direction, the distal end portions each allowing an associated one of the additional refrigerant pipes to be connected to the distal end portion, and at a distal end of each of the distal end portions, a dome-shaped flare is provided and allowed to be connected to a large-diameter tapered flare provided at an end portion of an associated one of the additional refrigerant pipes to be additionally installed.

2. The air-conditioning apparatus of claim 1, wherein the distal end portions of the valve kits of the one or more pairs of valve kits extend upwards in a vertical direction.

3. The air-conditioning apparatus of claim 1, wherein a portion from each of the refrigerant pipes by which the outdoor unit and the indoor unit is connected to an associated one of the distal end portions is inclined upwards relative to the horizontal direction.

4. The air-conditioning apparatus of claim 1, wherein an air-conditioning performance of the outdoor unit is previously enhanced by the number of indoor units to be additionally installed, compared with an air-conditioning performance necessary for the number of indoor units at time of installing the air-conditioning apparatus.

5. The air-conditioning apparatus of claim 1, wherein each of the valve kits of the one or more pairs of valve kits includes an operation valve and a port, the operation valve being allowed freely to be opened and closed for a flow passage of refrigerant that flows in the valve kit, the port being provided closer to the distal end portion than the operation valve and being open from the outside to the inside.

6. The air-conditioning apparatus of claim 1, wherein on an outer peripheral portion of each of the distal end portions, a screw portion is provided and screwable to a nut provided on an associated one of the additional refrigerant pipes to be additionally provided.

7. The air-conditioning apparatus of claim 6, wherein the screw portion is provided below a distal end of each of the distal end portions that is formed in the shape of a dome-shaped flare in such a manner as to be screwable to a flare nut provided on the associated additional refrigerant pipe.

8. An air-conditioning apparatus in which an outdoor unit installed in an outdoor space and an indoor unit installed in an indoor space are connected by refrigerant pipes to form a refrigerant circuit, wherein one or more pairs of valve kits are provided at the refrigerant pipes by which the outdoor unit and the indoor unit are connected, and allow a pair of additional refrigerant pipes on an inflow side and an outflow side to be connected to one of the one or more pairs of valve kits, the pair of additional refrigerant pipes being additionally provided to enable a new indoor unit to be added after installation of the air-conditioning apparatus, the valve kits of the one or more pairs of valve kits have respective distal end portions that are inclined upwards relative to a horizontal direction, the distal end portions each allowing an associated one of the additional refrigerant pipes to be connected to the distal end portion, and branch joints are each provided in the middle of an associated one of the refrigerant pipes by which the outdoor unit and the indoor unit are connected, and at each of the branch joints, an associated one of the refrigerant pipes connected to each of the valve kits of the one or more pairs of valve kits branches off.

9. The air-conditioning apparatus of claim 8, wherein the distal end portions of the valve kits of the one or more pairs of valve kits extend upwards in a vertical direction.

10. The air-conditioning apparatus of claim 8, wherein a portion from each of the refrigerant pipes by which the outdoor unit and the indoor unit is connected to an associated one of the distal end portions is inclined upwards relative to the horizontal direction.

11. The air-conditioning apparatus of claim 8, wherein an air-conditioning performance of the outdoor unit is previously enhanced by the number of indoor units to be additionally installed, compared with an air-conditioning performance necessary for the number of indoor units at time of installing the air-conditioning apparatus.

12. The air-conditioning apparatus of claim 8, wherein each of the valve kits of the one or more pairs of valve kits includes an operation valve and a port, the operation valve being allowed freely to be opened and closed for a flow passage of refrigerant that flows in the valve kit, the port being provided closer to the distal end portion than the operation valve and being open from the outside to the inside.

* * * * *